US012215905B2

(12) United States Patent
Hirosaki et al.

(10) Patent No.: US 12,215,905 B2
(45) Date of Patent: Feb. 4, 2025

(54) AIR CONDITIONING APPARATUS

(71) Applicant: FUJITSU GENERAL LIMITED, Kanagawa (JP)

(72) Inventors: Yu Hirosaki, Kanagawa (JP); Tokihiko Ando, Kanagawa (JP); Shintaro Sanada, Kanagawa (JP); Koya Aoki, Kanagawa (JP); Tatsuro Yamazaki, Kanagawa (JP)

(73) Assignee: FUJITSU GENERAL LIMITED, Kanagawa (JP)

( * ) Notice: Subject to any disclaimer, the term of this patent is extended or adjusted under 35 U.S.C. 154(b) by 614 days.

(21) Appl. No.: 17/441,906

(22) PCT Filed: Mar. 24, 2020

(86) PCT No.: PCT/JP2020/013164
§ 371 (c)(1),
(2) Date: Sep. 22, 2021

(87) PCT Pub. No.: WO2020/196565
PCT Pub. Date: Oct. 1, 2020

(65) Prior Publication Data

US 2022/0146165 A1 May 12, 2022

(30) Foreign Application Priority Data

Mar. 26, 2019 (JP) ..... 2019-058393

(51) Int. Cl.
*F25B 49/02* (2006.01)
*F25B 13/00* (2006.01)

(52) U.S. Cl.
CPC ..... *F25B 49/02* (2013.01); *F25B 13/00* (2013.01); *F25B 2313/0314* (2013.01);
(Continued)

(58) Field of Classification Search
CPC ..... F25B 49/02; F25B 2600/2513; F25B 2700/21152; F25B 2700/1931; F25B 2700/21; F25B 2400/0411; F25B 40/06
See application file for complete search history.

(56) References Cited

U.S. PATENT DOCUMENTS 5,651,263 A * 7/1997 Nonaka ..... F25B 13/00 62/502
5,768,902 A 6/1998 Nonaka et al.
(Continued)

FOREIGN PATENT DOCUMENTS

CN 1321867 11/2001
CN 1580670 2/2005
(Continued)

OTHER PUBLICATIONS

Notification to Grant Patent Right for Invention Issued in Corresponding CN Patent Application No. 202080022820.4, dated Jul. 25, 2022, along with an English translation thereof.
(Continued)

*Primary Examiner* — Jianying C Atkisson
*Assistant Examiner* — Meraj A Shaikh
(74) *Attorney, Agent, or Firm* — Greenblum & Bernstein, P.L.C.

(57) ABSTRACT

An outdoor unit control unit includes a degree-of-dryness calculating unit that calculates the degree of dryness of a refrigerant flowing into an heat exchanger (an indoor heat exchanger at the time of a cooling operation, and an outdoor heat exchanger at the time of a heating operation) disposed on the downstream side of a liquid pipe, and performs an inhibition mode of inhibiting, when the degree of dryness exceeds a threshold A, control that is performed in the direction of decreasing the degree of opening of the expansion valve (an indoor expansion valve at the time of the cooling operation, and an outdoor expansion valve at the
(Continued)

time of the heating operation) disposed on the upstream side of the liquid pipe.

6 Claims, 3 Drawing Sheets

(52) U.S. Cl.
CPC ..... *F25B 2313/0315* (2013.01); *F25B 2600/2513* (2013.01); *F25B 2700/1931* (2013.01); *F25B 2700/1933* (2013.01)

(56) References Cited

U.S. PATENT DOCUMENTS

| | | | | |
|---|---|---|---|---|
| 8,857,211 | B2 | 10/2014 | Morozumi et al. | |
| 2007/0074538 | A1* | 4/2007 | Kurata | F25B 41/335 62/239 |
| 2008/0236184 | A1 | 10/2008 | Morozumi et al. | |
| 2014/0318164 | A1* | 10/2014 | Hayakawa | B60H 1/00921 62/222 |
| 2014/0373569 | A1 | 12/2014 | Tsuboe et al. | |
| 2016/0146496 | A1 | 5/2016 | Yamashita | |
| 2017/0197490 | A1* | 7/2017 | Enomoto | B60H 1/00485 |
| 2018/0058740 | A1* | 3/2018 | Nishiyama | F25B 49/02 |
| 2020/0141609 | A1 | 5/2020 | Nakagawa et al. | |

FOREIGN PATENT DOCUMENTS

| | | | |
|---|---|---|---|
| CN | 101275568 | | 10/2008 |
| CN | 102032699 | | 4/2011 |
| CN | 105074353 | | 11/2015 |
| CN | 105143786 | | 12/2015 |
| CN | 109114838 | | 1/2019 |
| EP | 2320164 | A2 | 5/2011 |
| EP | 2320164 | A3 | 5/2014 |
| EP | 3199887 | | 8/2017 |
| JP | 2007-71461 | | 3/2007 |
| JP | 2010-2109 | | 1/2010 |
| JP | 2013-200090 | | 10/2013 |
| JP | 6058145 | | 1/2017 |
| JP | 2019-20112 | | 2/2019 |
| WO | 2014/155545 | | 10/2014 |

OTHER PUBLICATIONS

Extended European Search Report Issued in Corresponding EP Patent Application No. 20777456.3, dated Nov. 25, 2022.

International Search Report issued in International Patent Application No. PCT/JP2020/013164, dated Jun. 9, 2020, along with an English translation thereof.

* cited by examiner

AIR CONDITIONING APPARATUS

TECHNICAL FIELD

The present disclosure relates to an air conditioning apparatus.

BACKGROUND ART

In air conditioning apparatuses, in recent years, from a standpoint of prevention of global warming, a refrigerant with a low global warming coefficient of, for example, an R32 refrigerant is filled in a refrigerant circuit. Many of refrigerants with a low global warming coefficient including the R32 refrigerant are flammable refrigerants, so that an amount of refrigerant to be filled in the refrigerant circuit is reduced in order to decrease an amount of leakage in a case in which the refrigerant leaks out from the refrigerant circuit. As a way to reduce the amount of refrigerant, there is a method for reducing an inner diameter of a connection pipe (a liquid pipe and a gas pipe) that connects an indoor unit and an outdoor unit. If the inner diameter of the connection pipe is decreased, an internal volume of the refrigerant circuit is decreased, so that it is possible to reduce the amount of refrigerant to be filled in the refrigerant circuit.

CITATION LIST

Patent Literature

Patent Literature 1: Japanese Laid-open Patent Publication No. 2013-200090

SUMMARY OF INVENTION

Technical Problem

According to the method described above, a certain effect is expected for a goal; however, due to an increase in environmental regulation, there is a need to further reduce the amount of refrigerant by using another technique in combination. For example, there is a conceivable method for reducing the amount of refrigerant that is filled in the refrigerant circuit by controlling a refrigerant flowing inside the liquid pipe so as to always be in a low-density state.

In a case of an air conditioning apparatus that includes an expansion valve only in an outdoor unit, a refrigerant flowing inside a liquid pipe during a cooling operation is in a low-density and gas-liquid two phase state; however, the refrigerant flowing inside the liquid pipe during a heating operation is always in a high-density and liquid single phase state. In order to perform control such that the state of the refrigerant flowing inside the liquid pipe is in a low-density and gas-liquid two phase state during operation, there is a need to always reduce a pressure by using an expansion valve disposed on the upstream side of the liquid pipe in the refrigerant circuit at the time of the cooling operation and at the time of the heating operation. Accordingly, it is conceivable to arrange an expansion valve to each of the indoor unit and the outdoor unit.

In an air conditioning apparatus that includes an expansion valve in each of an indoor unit and an outdoor unit, a pressure is not reduced in the expansion valve that is disposed on the downstream side of the liquid pipe in the refrigerant circuit; therefore, control is performed such that the expansion valve is fully opened. Furthermore, if the degree of opening of the expansion valve disposed on the upstream side of the liquid pipe is changed, the degree of dryness of the refrigerant that is in the gas-liquid two phase state, that passes through the liquid pipe and the expansion valve that is disposed on the downstream side of the liquid pipe, and that flows into the heat exchanger disposed on the downstream side varies. If the degree of dryness varies, a refrigerant density is changed. For example, if the degree of dryness is increased, the refrigerant density is decreased. If the density of the refrigerant flowing inside the liquid pipe and the expansion valve disposed on the downstream side is decreased, the flow rate of the refrigerant becomes high as compared to a case in which the density of the refrigerant is high. Consequently, a pressure loss occurring at the time at which the refrigerant flows inside the liquid pipe and the expansion valve that is disposed on the downstream side is increased and the pressure of the refrigerant is decreased.

Namely, if the expansion valve disposed on the upstream side of the liquid pipe is controlled when the degree of dryness of the refrigerant that is in the gas-liquid two phase state and that flows into the heat exchanger disposed on the downstream side of the liquid pipe, a total amount of decompression (expansion valve disposed on the upstream side+liquid pipe+expansion valve disposed on the downstream side) at the time of changing the expansion valve in the direction of decreasing the degree of opening of the expansion valve disposed on the upstream side of the liquid pipe becomes large. Consequently, controllability becomes worse. For example, if an amount of decompression per units of control variable of the expansion valve is rapidly increased, a low pressure in the refrigerant circuit in the air conditioning apparatus is excessively decreased. Consequently, the reliability is degraded due to an excessive rise in temperature of the compressor caused by an excessive decrease in the density of the refrigerant taken into the compressor.

Accordingly, in the present disclosure, a technology capable of preventing a decrease in reliability of a compressor while reducing an amount of refrigerant to be filled in a refrigerant circuit is proposed.

Solution to Problem

In one aspect of the disclosed embodiment, an air conditioning apparatus includes a refrigerant circuit and a control unit. In the refrigerant circuit, a compressor, a channel switching unit, an indoor heat exchanger, a first expansion valve, a liquid pipe, a second expansion valve, and an outdoor heat exchanger are connected in series. The control unit performs switching control of the channel switching unit and that performs degree-of-opening control of the first expansion valve and the second expansion valve. The control unit switches the channel switching unit such that a refrigerant flows through in the order of the indoor heat exchanger, the first expansion valve, the liquid pipe, the second expansion valve, and the outdoor heat exchanger at the time of a heating operation. The control unit includes a degree-of-dryness calculating unit that calculates a degree of dryness of the refrigerant flowing into the outdoor heat exchanger at the time of the heating operation. The control unit performs, at the time of the heating operation, when the degree of dryness is less than or equal to a threshold that is determined in advance, a normal mode of controlling the first expansion valve such that the refrigerant flowing inside the liquid pipe is in a gas-liquid two phase state and controlling the second expansion valve such that the degree of opening of the second expansion valve is equal to a predetermined degree of opening. And the control unit performs an inhibition mode of inhibiting, when the degree of dryness exceeds the threshold, control that is performed in the direction of decreasing the degree of opening of the first expansion valve.

Advantageous Effects of Invention

According to the present disclosure, it is possible to prevent a decrease in reliability of a compressor while reducing an amount of refrigerant to be filled in the refrigerant circuit.

EMBODIMENTS FOR CARRYING OUT THE INVENTION

Preferred embodiments of an air conditioning apparatus disclosed in the present disclosure will be explained in detail below with reference to the accompanying drawings. Furthermore, the technology of the present disclosure is not limited to the embodiments.

[Configuration of Air Conditioning Apparatus]

Figure 1A:
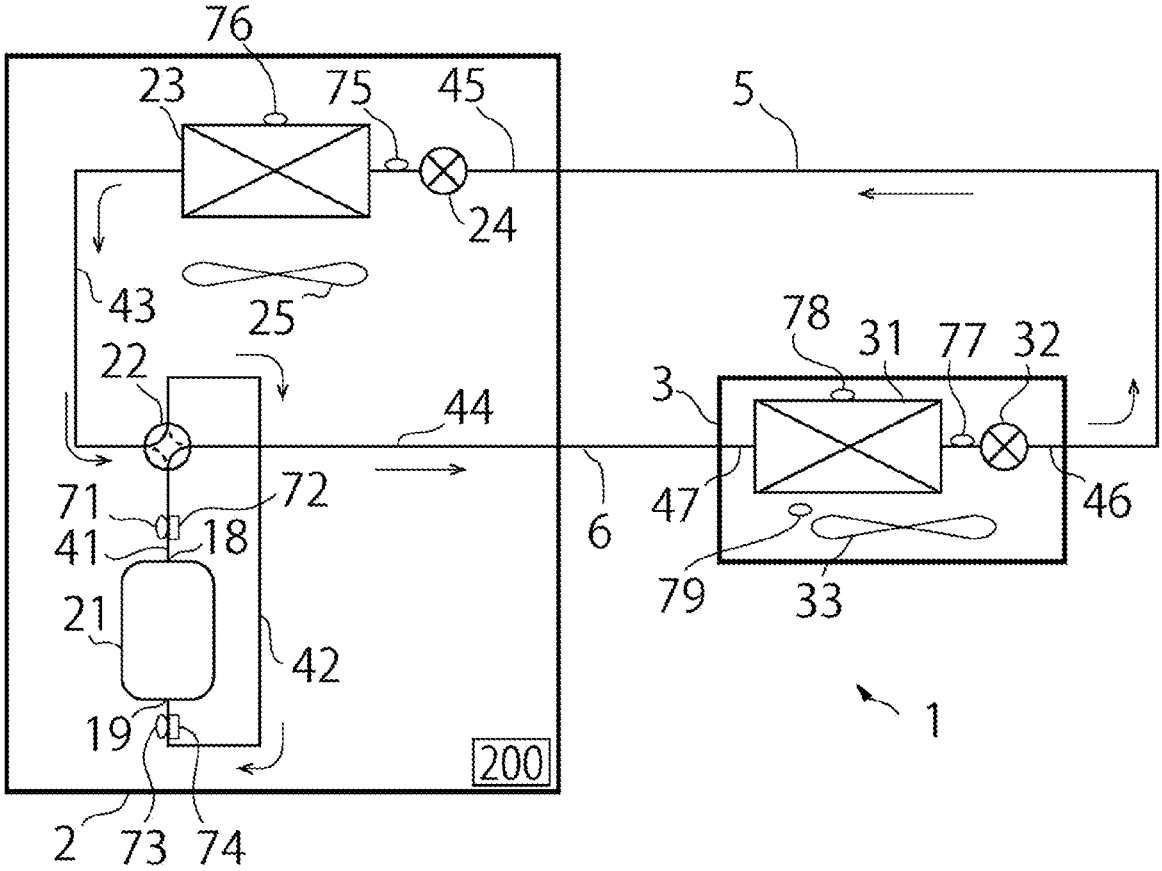
FIG. 1A is a refrigerant circuit diagram illustrating an air conditioning apparatus according to the present disclosure.

FIG. 1A is a refrigerant circuit diagram illustrating an air conditioning apparatus according to the present disclosure. An air conditioning apparatus 1 is applied to an air conditioning apparatus that cools and heats inside a room and includes, as illustrated in FIG. 1A, an outdoor unit 2 and an indoor unit 3. The outdoor unit 2 is connected to the indoor unit 3 by a liquid pipe 5 and a gas pipe 6. The outdoor unit 2 includes a compressor 21, a four-way valve (channel switching unit) 22, an outdoor heat exchanger 23, an outdoor expansion valve 24 (second expansion valve), and an outdoor unit control unit 200 (control unit). The indoor unit 3 includes an indoor heat exchanger 31 and an indoor expansion valve (first expansion valve) 32.

The compressor 21 includes a discharge port 18 as a discharge portion and an intake port 19 as an intake portion. The compressor 21 compresses, by being controlled by the outdoor unit control unit 200, a refrigerant supplied from the intake port 19 via an intake pipe 42 and a four-way valve 22, and then, supplies the compressed refrigerant from the discharge port 18 to the four-way valve 22 via a discharge pipe 41.

The four-way valve 22 is connected to the discharge pipe 41 and the intake pipe 42, is connected to the outdoor heat exchanger 23 via a refrigerant pipe 43, and is connected to the indoor unit 3 via a refrigerant pipe 44 and the gas pipe 6. The indoor unit 3 and the outdoor heat exchanger 23 are connected via a refrigerant pipe 45. The four-way valve 22 switches, by being controlled by the outdoor unit control unit 200, the air conditioning apparatus 1 to one of a heating mode and a cooling mode. When the air conditioning apparatus 1 is switched to the cooling mode, the four-way valve 22 supplies, to the outdoor heat exchanger 23, the refrigerant discharged from the compressor 21 via the discharge pipe 41 and supplies, to the compressor 21 via the intake pipe 42, the refrigerant flowing out from the indoor unit 3. When the air conditioning apparatus 1 is switched to the heating mode, the four-way valve 22 supplies, to the indoor unit 3, the refrigerant discharged from the compressor 21 via the discharge pipe 41 and supplies, to the compressor 21 via the intake pipe 42, the refrigerant flowing out from the outdoor heat exchanger 23.

The outdoor heat exchanger 23 is connected to the outdoor expansion valve 24 via the refrigerant pipe 45. An outdoor fan 25 is arranged in the vicinity of the outdoor heat exchanger 23. The outdoor fan 25 brings outside air into the interior of the outdoor unit 2 by being rotated by a fan motor (not illustrated) and releases the outside air, which is subjected to heat exchange with the refrigerant by the outdoor heat exchanger 23, to the outside of the outdoor unit 2. The outdoor heat exchanger 23 performs heat exchange, in a case of a cooling mode, between the refrigerant supplied from the four-way valve 22 and the outside air that is brought into the interior of the outdoor unit 2, and then, supplies the refrigerant, which has been subjected to heat exchange, to the expansion valve 24. The outdoor heat exchanger 23 performs heat exchange, in a case of a heating mode, between the refrigerant supplied from the outdoor expansion valve 24 and the outside air that is brought into the interior of the outdoor unit 2, and then, supplies the refrigerant that has been subjected to heat exchange to the four-way valve 22.

The outdoor expansion valve 24 is connected to the indoor expansion valve 32 included in the indoor unit 3 via the refrigerant pipe 45, the liquid pipe 5, and a refrigerant pipe 46. The outdoor expansion valve 24 decompresses, in a case of a cooling mode, the refrigerant supplied from the outdoor heat exchanger 23 by performing adiabatic expansion, and supplies a gas-liquid two-phase refrigerant that that enters a low-temperature and low-pressure state to the indoor unit 3. The outdoor expansion valve 24 decompresses, in a case of a heating mode, the refrigerant supplied from the indoor unit 3 by performing adiabatic expansion, and supplies a gas-liquid two-phase refrigerant that enters a low-temperature low-pressure to the outdoor heat exchanger 23. Furthermore, the degree of opening of the outdoor expansion valve 24 is adjusted by being controlled by the outdoor unit control unit 200 and the outdoor expansion valve 24 adjusts, in a case of a heating mode, the flow rate of the refrigerant supplied from the indoor unit 3 to the outdoor heat exchanger 23. In a case of a cooling mode, the outdoor expansion valve 24 adjusts the flow rate of the refrigerant that is supplied from the outdoor heat exchanger 23 to the indoor unit 3.

In addition to the configuration described above, a discharge temperature sensor 71 that detects a temperature of the refrigerant discharged from the compressor 21 (discharge temperature described above) and a discharge pressure sensor 72 that detects a pressure are provided at the discharge pipes 41 included in the outdoor unit 2. Furthermore, an intake temperature sensor 73 that detects a temperature of the refrigerant that is taken in the compressor 21 (intake temperature) and an intake pressure sensor 74 that detects a pressure are provided at the intake pipe 42. Furthermore, between the outdoor expansion valve 24 and the outdoor heat exchanger 23 in the refrigerant pipe 45, an outdoor-side refrigerant temperature sensor 75 that detects a temperature of the refrigerant passing through the subject point is arranged. Furthermore, an outdoor heat exchange intermediate temperature sensor 76 that detects a temperature of the refrigerant flowing inside the outdoor heat exchanger 23 is provided at the outdoor heat exchanger 23.

The indoor unit 3 includes the indoor heat exchanger 31, the indoor expansion valve 32, and an indoor fan 33. The indoor expansion valve 32 is connected to the indoor heat exchanger 31 via the refrigerant pipe 46. The indoor expansion valve 32 decompresses, in a case of a cooling mode, the refrigerant supplied from the outdoor unit 2 by performing adiabatic expansion, and then, supplies a gas-liquid two-phase refrigerant that enters a low-temperature low-pressure state to the indoor heat exchanger 31. The indoor expansion valve 32 decompresses, in a case of a heating mode, the refrigerant supplied from the indoor heat exchanger 31 by performing adiabatic expansion, and then, supplies a gas-liquid two-phase refrigerant that enters the low-temperature low-pressure state to the outdoor unit 2.

The indoor fan 33 is arranged in the vicinity of the indoor heat exchanger 31, brings indoor air into the interior of the indoor unit 3 by being rotated by a fan motor (not illustrated), and releases the indoor air that has been subjected to heat exchange with the refrigerant by the indoor heat exchanger 31. The indoor heat exchanger 31 is connected to the four-way valve 22 via the refrigerant pipe 44 and is connected to the indoor expansion valve 32 via the refrigerant pipe 45.

The indoor heat exchanger 31 is connected to the four-way valve 22 via a refrigerant pipe 47, the gas pipe 6, and the refrigerant pipe 44. The indoor heat exchanger 31 functions as an evaporator when the air conditioning apparatus 1 is switched to the cooling mode, and functions as a condenser when the air conditioning apparatus 1 is switched to the heating mode. Namely, the indoor heat exchanger 31 performs heat exchange, in a case of the cooling mode, between the gas-liquid two-phase refrigerant, which is supplied from the indoor expansion valve 32 and is into the low-temperature low-pressure state, and indoor air, which is brought into the interior of the indoor unit 3, releases the indoor air that has been subjected to heat exchange into a room, and supplies the refrigerant that has been subjected to heat exchange to the four-way valve 22. The indoor heat exchanger 31 performs heat exchange, in a case of the heating mode, between the refrigerant that is supplied from the four-way valve 22 and the indoor air that is brought in the interior of the indoor unit 3, releases the indoor air that has been subjected to heat exchange, and supplies the refrigerant that has been subjected to heat exchange to the indoor expansion valve 32.

In addition to the configuration described above, between the indoor expansion valve 32 and the indoor heat exchanger 31 connected via the refrigerant pipe 46, an indoor-side refrigerant temperature sensor 77 that detects a temperature of the refrigerant passing through the subject point is arranged. Furthermore, an indoor heat exchange intermediate temperature sensor 78 that detects a temperature of the refrigerant flowing through the interior of the indoor heat exchanger 31 is arranged at the indoor heat exchanger 31. Furthermore, an indoor temperature sensor 79 that detects a room temperature, i.e., a temperature of the indoor air flowing into the interior of the indoor unit 3, is arranged in the vicinity of an inlet port, which is not illustrated, of the indoor unit 3.

[Configuration of Outdoor Unit Control Unit]

Figure 1B:
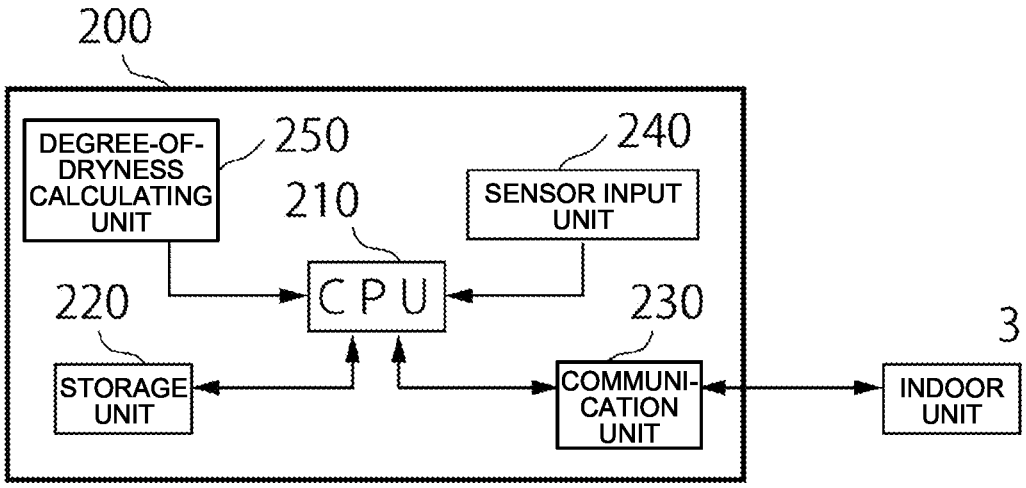
FIG. 1B is a block diagram illustrating an outdoor unit control unit in the air conditioning apparatus according to the present disclosure.

The outdoor unit control unit 200 is constituted by what is called a microcomputer and is mounted on a control substrate that is stored in an electrical component box, which is not illustrated, included in the outdoor unit 2. As illustrated in FIG. 1B, the outdoor unit control means 200 includes a CPU 210, a storage unit 220, a communication unit 230, a sensor input unit 240, and a degree-of-dryness calculating unit (degree-of-dryness calculating means) 250 (hereinafter, in this specification, the outdoor unit control means 200 is sometimes simply referred to as a control means).

The storage unit 220 is constituted by a flash memory and stores therein a control program of the outdoor unit 2, detection values associated with respective detection signals from various sensors, a control state of, for example, the compressor 21 or the outdoor fan 25, or the like. Furthermore, although not illustrated, the storage unit 220 stores therein, in advance, a rotation speed table in which the rotation speed of the compressor 21 is defined in accordance with a request capacity received from the indoor unit 3.

The communication unit 230 is an interface for communicating with the indoor unit 3. The sensor input unit 240 acquires detection results obtained from various sensors included in the outdoor unit 2 and outputs the acquired detection results to the CPU 210. The degree-of-dryness calculating unit 250 calculates the degree of dryness of the refrigerant from the detection results obtained from the various sensors included in the outdoor unit 2.

The CPU 210 acquires, via the sensor input unit 240, the above described detection result obtained from each of the sensors included in the outdoor unit 2. Furthermore, the CPU 210 acquires a control signal sent from the indoor unit 3 via the communication unit 230. The CPU 210 performs drive control of the compressor 21 or the outdoor fan 27 on the basis of the acquired detection results, the control signal, or the like. Furthermore, the CPU 210 performs switching control of the four-way valve 22 on the basis of the acquired detection results or the control signal. Furthermore, the CPU 210 adjusts the degree of opening of the outdoor expansion valve 24 or the indoor expansion valve 32 on the basis of the acquired detection results or the control signal.

In the above, the air conditioning apparatus 1 according to the embodiment is configured as a single type that includes a single piece of the indoor unit 3 associated with a single piece of the outdoor unit 2; however, the air conditioning apparatus 1 may also be configured as a multiple type that includes a plurality of the indoor units 3 associated with a single piece of the outdoor unit 2.

[Operation of Air Conditioning Apparatus]

When a user of the air conditioning apparatus 1 adjusts a temperature of a room in which the indoor unit 3 is arranged, the user starts up the air conditioning apparatus 1 by operating a remote controller, which is not illustrated, and inputs an operation condition to an indoor-unit control unit 500. When the operation condition is input, the indoor-unit control unit 500 sends the input operation condition and an indoor temperature to the outdoor unit control unit 200. The outdoor unit control unit 200 performs either the heating operation or the cooling operation on the basis of the operation condition received from the indoor-unit control unit 500 and the indoor temperature. In FIG. 1A, the flow of the refrigerant inside the refrigerant circuit at the time of the heating operation is indicated by an arrow.

[Cooling Operation]

When the outdoor unit control unit 200 performs the cooling operation, the outdoor unit control unit 200 switches the four-way valve 22 to the cooling mode by controlling the four-way valve 22. The compressor 21 controlled by the outdoor unit control unit 200 compresses a gas refrigerant taken in from the four-way valve 22 via the intake pipe 42. The compressor 21 discharges the compressed high-temperature and high-pressure gas refrigerant to the four-way valve 22. When the operation is switched to the cooling mode, the four-way valve 22 supplies, to the outdoor heat exchanger 23, the high-temperature and high-pressure gas refrigerant discharged from the compressor 21. The outdoor heat exchanger 23 condenses the high-temperature and high-pressure gas refrigerant to liquefies the gas refrigerant by performing heat exchange between the outside air that is brought into the interior of the outdoor unit 2 and the high-temperature and high-pressure gas refrigerant. The outdoor heat exchanger 23 supplies the high-pressure liquid refrigerant to the outdoor expansion valve 24.

The outdoor expansion valve 24 performs adiabatic expansion on the high-pressure liquid refrigerant supplied from the outdoor heat exchanger 23 to generate a low-temperature and low-pressure gas-liquid two-phase refrigerant. The outdoor expansion valve 24 supplies the low-temperature and low-pressure gas-liquid two-phase refrigerant to the indoor heat exchanger 31 via the indoor expansion valve 32 included in the indoor unit 3. The indoor heat exchanger 31 evaporates the low-temperature and low-pressure gas-liquid two-phase refrigerant to gasify the refrigerant by performing heat exchange between the low-temperature and low-pressure gas-liquid two-phase refrigerant that is supplied from the indoor expansion valve 32 and the indoor air that is brought in the interior of the indoor unit 3. The indoor heat exchanger 31 supplies a low-pressure gas refrigerant to the four-way valve 22. When the four-way valve 22 is switched to the cooling mode, the four-way valve 22 supplies, to the compressor 21, a low-pressure gas refrigerant flowing out from the indoor heat exchanger 31.

[Heating Operation]

When the outdoor unit control unit 200 performs the heating operation, the outdoor unit control unit 200 switches the four-way valve 22 to the heating mode by controlling the four-way valve 22. The compressor 21 controlled by the outdoor unit control unit 200 compresses the gas refrigerant taken in from the four-way valve 22 via the intake pipe 42. The compressor 21 discharges the compressed high-temperature and high-pressure gas refrigerant to the four-way valve 22. When the operation is switched to the heating mode, the four-way valve 22 supplies the high-temperature and high-pressure gas refrigerant discharged from the compressor 21 to the indoor heat exchanger 31 included in the indoor unit 3. The indoor heat exchanger 31 condenses the high-temperature and high-pressure gas refrigerant to liquefy the gas refrigerant by performing heat exchange between the high-temperature and high-pressure gas refrigerant that is supplied from the four-way valve 22 to the indoor unit 3 and the indoor air that is brought into the interior of the indoor unit 3. The indoor heat exchanger 31 supplies the high-pressure liquid refrigerant to the indoor expansion valve 32.

The indoor expansion valve 32 performs adiabatic expansion on the high-pressure liquid refrigerant supplied from the indoor heat exchanger 31 to generate a low-temperature and low-pressure gas-liquid two-phase refrigerant. The indoor expansion valve 32 supplies the low-temperature and low-pressure gas-liquid two-phase refrigerant to the outdoor heat exchanger 23 via the outdoor expansion valve 24. The outdoor heat exchanger 23 evaporates the low-temperature and low-pressure refrigerant to gasify the refrigerant by performing heat exchange between the outside air that is brought in the interior of the outdoor unit 2 and the low-temperature and low-pressure gas-liquid two-phase refrigerant that is supplied from the expansion valve 24. The outdoor heat exchanger 23 supplies a low-pressure gas refrigerant to the four-way valve 22. When the four-way valve 22 is being switched to the heating mode, the four-way valve 22 supplies, to the compressor 21, a low-pressure gas refrigerant flowing out from the outdoor heat exchanger 23.

[Control Performed by Outdoor Unit Control Unit (Control Means)]

In the following, a control method for controlling the outdoor expansion valve (the second expansion valve) 24 and the indoor expansion valve (the first expansion valve) 32 performed by the outdoor unit control unit (control means) 200 will be described in detail. Furthermore, in a description below, a control method performed by the outdoor unit control unit 200 at the time of the heating operation will be described and a description of the control method performed at the time of the cooling operation will be omitted. At the time of operation of the air conditioning apparatus 1, an indoor-unit control unit, which is not illustrated, outputs a set temperature that is an operation condition that is input by an operation performed by a user and a request rotation speed that is stored in a storage unit, which is not illustrated, included in the indoor-unit control unit and that is defined in advance from a room temperature detected by the indoor temperature sensor 79, and then, sends the set temperature and the request rotation speed to the outdoor unit control unit 200. The request rotation speed is a rotation speed of the compressor 21 needed to set the room temperature to the set temperature and is defined in accordance with a difference between the set temperature and the room temperature. The outdoor unit control unit 200 performs control such that the compressor 21 satisfies the request rotation speed.

When the air conditioning apparatus 1 performs the heating operation, the indoor expansion valve 32 adjusts the degree of opening such that the refrigerant inside the liquid pipe 5 enters a gas-liquid two phase state, and the outdoor expansion valve 24 performs control such that the degree of its opening is a predetermined degree of opening (full open). Specifically, the outdoor unit control unit 200 performs degree-of-opening control of the indoor expansion valve 32 on the basis of target discharge temperature control. The target discharge temperature control is control of adjusting the degree of opening of the expansion valve such that a discharge temperature Td is equal to a target value (target discharge temperature Tdt) for the purpose of setting the refrigerant taken into the compressor 21 to be in an appropriate state.

Here, the state of the refrigerant taken into the compressor 21 is defined to be in an appropriate state when the degree of dryness is about 1 (for example, 0.8 to 1.0) and a degree of suction superheat SH is about 0 (for example, 0 to 5). The reason is that, when the degree of dryness falls much below 1, a liquid refrigerant is taken into the compressor 21 and thus the compressor 21 may possibly fail due to liquid compression. Furthermore, when the degree of suction superheat SH far exceeds 0, the temperature inside the compressor 21 excessively rises, thus leading to degradation of reliability.

The target discharge temperature Tdt is calculated on the basis of the detection results that are detected by various sensors arranged in the air conditioning apparatus 1 and, namely, the target discharge temperature Tdt is an estimated value of the discharge temperature Td in a case in which the refrigerant taken into the compressor 21 is an appropriate state.

The detection results thereof includes detection values obtained by the discharge pressure sensor 72, the intake temperature sensor 73, the intake pressure sensor 74, the outdoor heat exchange intermediate temperature sensor 76, and the indoor heat exchange intermediate temperature sensor 78. The target discharge temperature Tgt is a value obtained by adding an adjusted value to a theoretical discharge temperature. The theoretical discharge temperature is a theoretical value calculated on the basis of a load condition of the air conditioning apparatus 1 specified by the detection results that are detected by various sensors without taking into account a pressure loss or an operating efficiency in the refrigerant circuit included in the air conditioning apparatus 1. The theoretical discharge temperature is calculated from the load condition of a refrigeration cycle (a pressure and a temperature of each unit) and the degree of target superheat Tsh. The degree of target superheat Tsh is set to be 0, i.e., the degree of dryness of the refrigerant flowing into the compressor 21 is about 1, and furthermore, the degree of suction superheat SH is about 0.

By performing control as described above, the refrigerant is decompressed, at the time of the heating operation, by the indoor expansion valve 32 disposed on the upstream side of the liquid pipe 5, so that it is possible to decrease the density of the refrigerant flowing inside the liquid pipe 5. Consequently, it is possible to reduce the amount of refrigerant to be filled in the refrigerant circuit.

Figure 3:
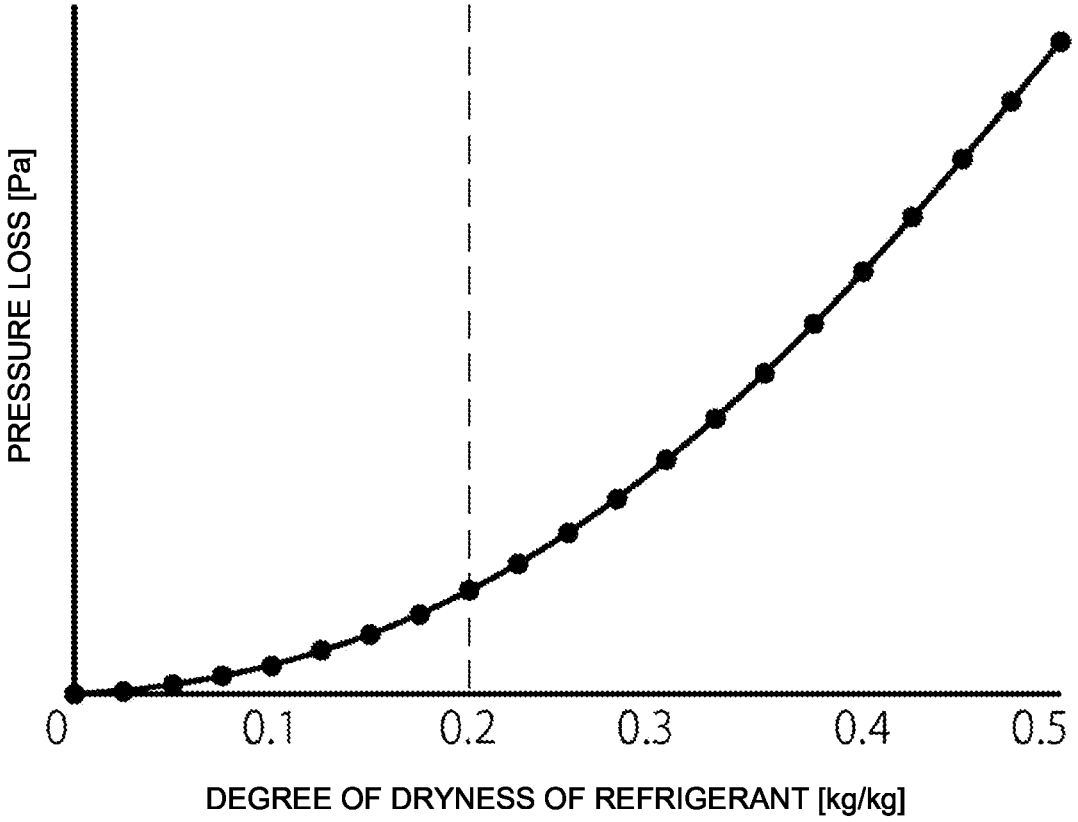
FIG. 3 is a graph illustrating a relationship between the degree of dryness and a refrigerant density [kg/m3] of a refrigerant that is in a gas-liquid two phase state.

In contrast, even when the outdoor expansion valve 24 that is the expansion valve disposed on the downstream side of the liquid pipe 5 is fully opened, the pressure of the refrigerant flowing out from the outdoor expansion valve 24 is decreased caused by a pressure loss due to channel resistance. Furthermore, when the degree of opening of the indoor expansion valve 32 is changed, the degree of dryness of the refrigerant that is in the gas-liquid two phase state and that passes through the liquid pipe 5 and the outdoor expansion valve 24 and that flows into the outdoor heat exchanger 23 varies. When the degree of dryness varies, the refrigerant density is changed. For example, when the degree of dryness rises, the refrigerant density is decreased. When the density of the refrigerant flowing inside the liquid pipe 5 and the indoor expansion valve 32 is decreased, the flow rate of the refrigerant is increased as compared to a case in which the density of the refrigerant is high. Consequently, a pressure loss occurring when the refrigerant flows through the liquid pipe 5 and the outdoor expansion valve 24 is increased and the pressure of the refrigerant flowing out from the liquid pipe 5 is decreased. FIG. 3 is a graph illustrating a relationship based on the degree of dryness of the refrigerant that is in the gas-liquid two phase state and a pressure loss [Pa] of the refrigerant passing through the liquid pipe 5 and the outdoor expansion valve 24 when the degree of dryness is 0. In the graph, the horizontal axis indicates the degree of dryness and the vertical axis indicates the pressure loss. Furthermore, the pressure loss indicated on the vertical axis is based on the state in which the degree of dryness is 0. As illustrated in the drawing, the pressure loss of the refrigerant passing through the liquid pipe 5 and the outdoor expansion valve 24 is rapidly increased in accordance with a rise in the degree of dryness.

Namely, when the degree of dryness of the refrigerant that flows into the outdoor heat exchanger 23 and that is in the gas-liquid two phase state is high, when the indoor expansion valve 32 that is the expansion valve disposed on the upstream side of the liquid pipe 5 is controlled, the total amount of decompression (the indoor expansion valve 32+the liquid pipe 5+the outdoor expansion valve 24) at the time of a change in the degree of opening of the indoor expansion valve 32 is increased. Consequently, controllability becomes worse. For example, when an amount of decompression per units of control variable of the expansion valve is rapidly increased, a low pressure in the refrigerant circuit in the air conditioning apparatus 1 is excessively decreased. Consequently, the reliability is degraded due to an excessive rise in temperature of the compressor 21 caused by an excessive decrease in the density of the refrigerant taken into the compressor 21. Conventionally, the degree of dryness of the refrigerant flowing into the evaporator (heat exchanger disposed on the downstream side of the liquid pipe) during an operation in which the discharge temperature Td is stable in the vicinity of the target discharge temperature Tdt shifts within a range between 0.1 and 0.2. Accordingly, when the degree of dryness exceeds 0.2, the total amount of decompression (the indoor expansion valve 32+the liquid pipe 5+the outdoor expansion valve 24) at the time of a change in the degree of opening of the indoor expansion valve 32 is increased, and thus, it may be said that the reliability of the compressor 21 possibly be degraded.

Thus, the outdoor unit control unit 200 includes the degree-of-dryness calculating unit 250 that calculates the degree of dryness of the refrigerant flowing into the heat exchanger (the outdoor heat exchanger 23 at the time of the heating operation) disposed on the downstream side of the liquid pipe 5, and performs, when the calculation result (the degree of dryness) obtained by the degree-of-dryness calculating means 250 exceeds a threshold A, an inhibition mode of inhibiting control that is performed in the direction of decreasing the degree of opening of the expansion valve (the indoor expansion valve 32 at the time of the heating operation) disposed on the upstream side of the liquid pipe 5. Consequently, even in a case in which an amount of decompression per units of control variable of the expansion valve is increased, it is possible to prevent a decrease in reliability of the compressor.

Furthermore, the outdoor unit control unit 200 performs target discharge temperature control of the degree of opening of the expansion valve (the outdoor expansion valve 24 at the time of the heating operation) disposed on the downstream side during the inhibition mode. Consequently, even during the inhibition mode, it is possible to perform control such that the refrigerant taken into the compressor 21 is in an appropriate state.

Figure 2:
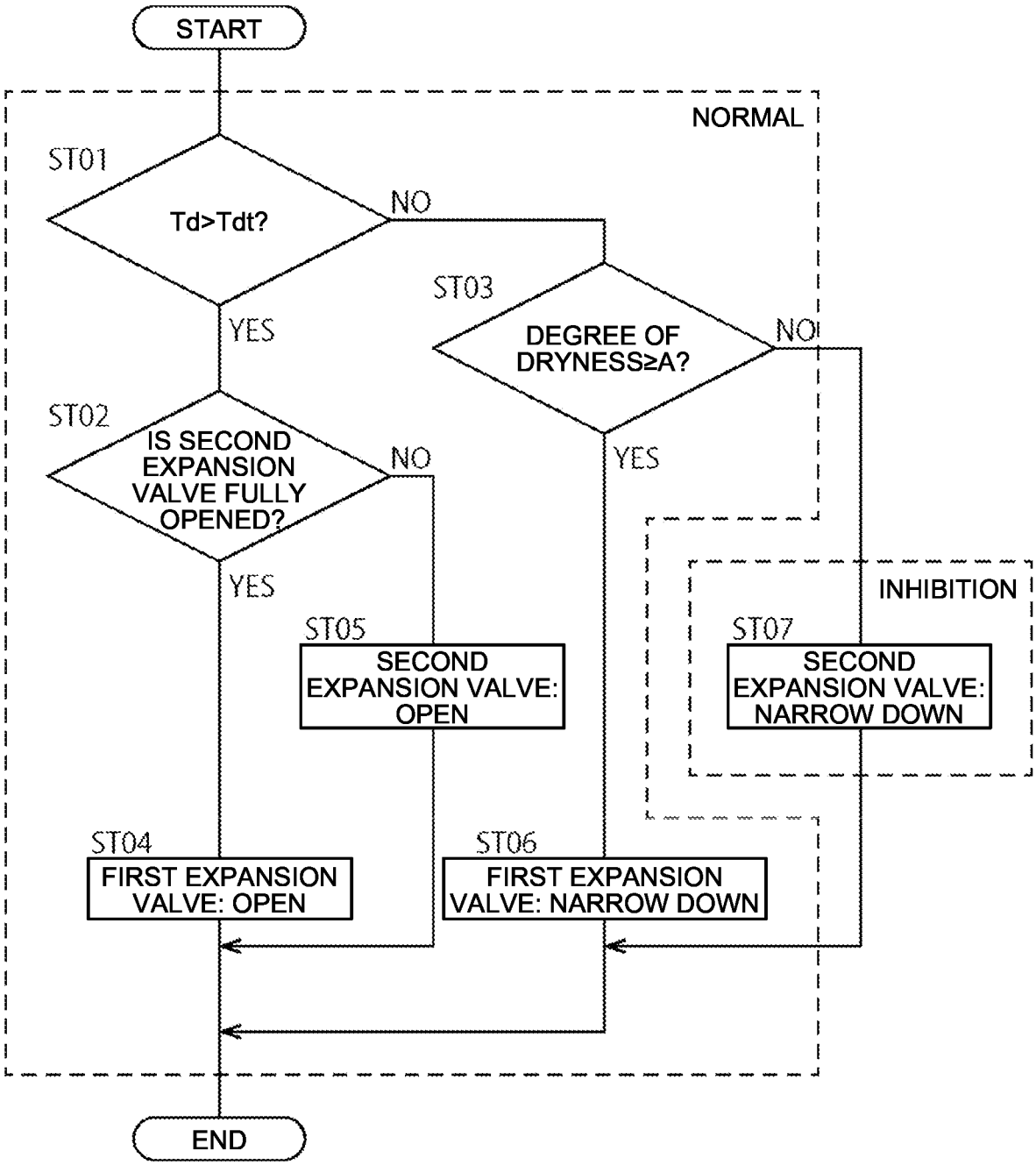
FIG. 2 is a flowchart illustrating a control method performed at the time of a heating operation of an outdoor unit control unit 200 according to the present disclosure.

In the following, a control method performed by the outdoor unit control unit (control means) 200 according to the present disclosure will be described in detail with reference to FIG. 2 and FIG. 3. FIG. 2 is a flowchart illustrating a control method performed by the outdoor unit control unit 200 at the time of the heating operation. During the heating operation, the outdoor unit control unit 200 repeatedly performs the process at Step ST01 and the subsequent processes.

First, the outdoor unit control unit 200 judges whether the discharge temperature Td detected by the discharge temperature sensor 71 exceeds the target discharge temperature Tdt (ST01). The target discharge temperature Tdt is calculated, as described above, on the basis of the detection results detected by the various sensors arranged in the air conditioning apparatus 1, and the detection results thereof include detection values obtained by the discharge pressure sensor 72, the intake temperature sensor 73, the intake pressure sensor 74, the outdoor heat exchange intermediate temperature sensor 76, and the indoor heat exchange intermediate temperature sensor 78.

When the discharge temperature Td exceeds the target discharge temperature Tdt (YES at ST01), it is judged whether the outdoor expansion valve (the second expansion valve) 24 is a predetermined degree of opening, i.e., is fully opened (ST02). When the outdoor expansion valve 24 is fully opened (YES at ST02), the outdoor unit control unit 200 controls the degree of opening of the indoor expansion valve (the first expansion valve) 32 in the direction of opening the indoor expansion valve 32 (ST04), and decreases the discharge temperature Td. When the outdoor expansion valve 24 is not fully opened (NO at ST02), the outdoor unit control unit 200 controls the outdoor expansion valve 24 in the direction of opening the outdoor expansion valve 24 (ST04 ST05), and decreases the discharge temperature Td. When the indoor expansion valve 32 is controlled in the direction of opening the indoor expansion valve 32 that is disposed on the upstream side of the liquid pipe 5, the density of the refrigerant flowing inside the liquid pipe 5 rises, which is preferable when an amount of decompression can be adjusted by the outdoor expansion valve 24 disposed on the downstream side of the liquid pipe 5.

Furthermore, when the discharge temperature Td is equal to or less than the target discharge temperature Tdt (NO at ST01), the outdoor unit control unit 200 judges whether the degree of dryness of the refrigerant flowing into the outdoor heat exchanger 23 is equal to or less than the threshold A (ST03), and, when the degree of dryness is equal to or less than the threshold A (YES at ST03), the outdoor unit control unit 200 controls the indoor expansion valve (the first expansion valve) 32 in the direction of narrowing (decreasing the degree of opening) the indoor expansion valve (the first expansion valve) 32 such that the discharge temperature Td is equal to the target discharge temperature Tdt (ST06). The threshold A is stored in advance in a storage unit, which is not illustrated, included in the outdoor unit control unit 200. The degree of dryness of the refrigerant flowing into the outdoor heat exchanger 23 can be calculated from a condensation temperature (a detection value obtained by the indoor heat exchange intermediate temperature sensor 78 at the time of the heating operation), an evaporation temperature (a detection value obtained by the outdoor heat exchange intermediate temperature sensor 76 at the time of the heating operation), and a condenser outlet temperature (a detection value obtained by the indoor-side refrigerant temperature sensor 77 at the time of the heating operation). The threshold A is, for example, as described above, 0.2. Furthermore, an allowable value of the threshold A varies in accordance with an inner diameter or a length of the liquid pipe 5, a valve diameter of the outdoor expansion valve 24, or the like. Specifically, when the inner diameter of the liquid pipe 5 is small, the length of the liquid pipe 5 is long, or the valve diameter of the outdoor expansion valve 24 is small, a pressure loss of the refrigerant passing through the liquid pipe 5 and the outdoor expansion valve 24 is large. Accordingly, even in a case of the same degree of dryness, the threshold A is set to be a small value as compared to a case in which the inner diameter of the liquid pipe 5 is large, the length of the liquid pipe 5 is small, or the valve diameter of the outdoor expansion valve 24 is large. Furthermore, as the circulation volume of the refrigerant is increased, the pressure loss of the refrigerant passing through the liquid pipe 5 and the outdoor expansion valve 24 is increased. Accordingly, the threshold A may also be changed in accordance with a change in the circulation volume of the refrigerant. Specifically, as the rotation speed of the compressor 21 is increased, a larger value may also be set to the threshold A.

In contrast, when the degree of dryness exceeds the threshold A (NO at ST03), the outdoor unit control unit 200 starts an inhibition mode of inhibiting control that is performed in the direction of narrowing the indoor expansion valve 32 (ST07), the outdoor unit control unit 200 performs control the outdoor expansion valve (the second expansion valve) 24 (decreasing the degree of opening) instead of the indoor expansion valve 32 in the direction of narrowing the outdoor expansion valve (the second expansion valve) 24 such that the discharge temperature Td is equal to the target discharge temperature Tdt (ST08). When the degree of dryness exceeds 0.1, the refrigerant density is rapidly changed in accordance with a change in the degree of dryness. When a control is performed in the direction of narrowing the indoor expansion valve, the pressure loss of the refrigerant flowing inside the liquid pipe 5 and the indoor expansion valve 32 is increased, so that the total amount of decompression may possibly and rapidly be increased. Accordingly, by narrowing the outdoor expansion valve 24 disposed on the most downstream side, an increase in the total amount of decompression is prevented. After that, the outdoor unit control unit 200 ends the inhibition mode (ST09).

As described above, when the degree of dryness of the refrigerant flowing into the outdoor heat exchanger 23 is less than or equal to the threshold A, the outdoor unit control unit 200 performs a normal mode of controlling the indoor expansion valve (the first expansion valve) 32 such that the refrigerant flowing inside the liquid pipe 5 is in the gas-liquid two phase state, and controlling the outdoor expansion valve (the second expansion valve) 24 such that the degree of opening of the outdoor expansion valve (the second expansion valve) 24 is equal to a predetermined degree of opening (full open) (ST01 to ST06). Furthermore, when the degree of dryness of the refrigerant flowing into the outdoor heat exchanger 23 exceeds the threshold A, the outdoor unit control unit 200 performs the inhibition mode of inhibiting control that is performed in the direction of decreasing the degree of opening of the indoor expansion valve (the first expansion valve) 32, and controls the degree of opening of the outdoor expansion valve (the second expansion valve) 24 such that the refrigerant taken into the compressor 21 is in an appropriate state during the inhibition mode. Accordingly, even when the degree of dryness of the refrigerant flowing into the outdoor heat exchanger 23 is high and an amount of decompression per units of control variable of the expansion valve is increased, it is possible to prevent a decrease in reliability of the compressor. Furthermore, even during the inhibition mode, it is possible to perform control such that the refrigerant taken into the compressor 21 is in an appropriate state.

Furthermore, in the embodiment, a description has been given of the control method performed by the outdoor unit control unit 200 at the time of the heating operation; however, the technology described in the present disclosure is also applicable at the time of the cooling operation. In a case of the cooling operation, the outdoor unit control unit 200 includes the degree-of-dryness calculating unit 250 that calculates the degree of dryness of the refrigerant flowing into the indoor heat exchanger 31 that is the heat exchanger disposed on the downstream side of the liquid pipe 5, and, when the degree of dryness exceeds the threshold A, the outdoor unit control unit 200 performs the inhibition mode of inhibiting control that is performed in the direction of reducing the degree of opening of the outdoor expansion valve (the second expansion valve) 24 that is the expansion valve disposed on the upstream side of the liquid pipe 5. Accordingly, even when an amount of decompression of the units of control variable of the expansion valve is increased, it is possible to prevent a decrease in reliability of the compressor.

Furthermore, the outdoor unit control unit 200 controls the degree of opening of the indoor expansion valve (the first expansion valve) 32 that is the expansion valve disposed on the downstream side of the liquid pipe 5 such that the refrigerant taken into the compressor 21 is in an appropriate state during the inhibition mode. Accordingly, even during the inhibition mode, it is possible to perform control such that the refrigerant taken into the compressor 21 is in an appropriate state.

Furthermore, in the embodiment, the expansion valve (at the time of normal mode) disposed on the upstream side of the liquid pipe 5 and the expansion valve (at the time of inhibition mode) disposed on the downstream side of the liquid pipe 5 are subjected to degree-of-opening control on the basis of target discharge temperature control. However, the embodiment is not limited to this as long as the degree of opening can be adjusted such that the refrigerant inside the liquid pipe 5 is in a gas-liquid two phase state; therefore, it may also be possible to use a method (degree of target superheat control) for performing control such that the degree of suction superheat, instead of the discharge temperature, is equal to a target value (for example, 2 to 5). Furthermore, the degree of suction superheat is calculated from, for example, an evaporation temperature (a detection value of the indoor heat exchange intermediate temperature sensor 78 at the time of cooling operation and a detection value of the outdoor heat exchange intermediate temperature sensor 76 at the time of the heating operation) and an intake temperature (a detection value of the intake temperature sensor 73).

EXPLANATION OF REFERENCE

1 air conditioning apparatus
2 outdoor unit
200 outdoor unit control unit
21 compressor
22 four-way valve
23 outdoor heat exchanger
24 outdoor expansion valve (second expansion valve)
25 outdoor fan
41 discharge pipe
42 intake pipe
43 refrigerant pipe
44 refrigerant pipe
45 refrigerant pipe
46 refrigerant pipe
47 refrigerant pipe
3 indoor unit
31 indoor heat exchanger
32 indoor expansion valve (first expansion valve)
33 indoor fan
71 discharge temperature sensor
72 discharge pressure sensor
73 intake temperature sensor
74 intake pressure sensor
75 outdoor-side refrigerant temperature sensor
76 outdoor heat exchange intermediate temperature sensor
77 indoor-side refrigerant temperature sensor
78 indoor heat exchange intermediate temperature sensor
79 indoor temperature sensor

What is claimed is:

1. An air conditioning apparatus comprising:

a refrigerant circuit in which a compressor, a channel switching valve, an indoor heat exchanger, a first expansion valve, a liquid pipe, a second expansion valve, and an outdoor heat exchanger are connected in series; and a controller, including at least a processor and a memory, configured to perform switching control of the channel switching valve and to perform degree-of-opening control of the first expansion valve and the second expansion valve, wherein the controller is configured to:

switch the channel switching valve such that a refrigerant flows through in the order of the indoor heat exchanger, the first expansion valve, the liquid pipe, the second expansion valve, and the outdoor heat exchanger at the time of a heating operation, calculate a degree-of-dryness of the refrigerant flowing into the outdoor heat exchanger at the time of the heating operation based on a condensation temperature detected by an indoor heat exchange temperature sensor at the time of the heating operation, an evaporation temperature detected by an outdoor heat exchange temperature sensor at the time of the heating operation, and a condenser outlet temperature detected by an indoor-side refrigerant temperature sensor at the time of the heating operation, perform, at the time of the heating operation, when the degree-of-dryness is less than or equal to a threshold that is determined in advance, a normal mode of controlling the first expansion valve such that the refrigerant flowing inside the liquid pipe is in a gas-liquid two phase state and controlling the second expansion valve such that the degree of opening of the second expansion valve is equal to a predetermined degree of opening, and perform an inhibition mode of inhibiting, when the degree-of-dryness exceeds the threshold, control that is performed in the direction of decreasing the degree of opening of the first expansion valve.

2. The air conditioning apparatus according to claim 1, wherein the controller is further configured to:

detect a discharge temperature that is a temperature of the refrigerant discharged from the compressor, and control, during the inhibition mode, the degree of opening of the second expansion valve such that the discharge temperature is equal to a target value.

3. The air conditioning apparatus according to claim 1, wherein the controller is further configured to:

calculate a degree of superheat of the refrigerant taken into the compressor, and control the degree of opening of the second expansion valve such that the degree of superheat is equal to a target value during the inhibition mode.

4. An air conditioning apparatus comprising:

a refrigerant circuit in which a compressor, a channel switching valve, an indoor heat exchanger, a first expansion valve, a liquid pipe, a second expansion valve, and an outdoor heat exchanger are connected in series; and a controller, including at least a processor and a memory, configured to perform switching control of the channel switching valve and to perform degree-of-opening control of the first expansion valve and the second expansion valve, wherein the controller is configured to:

switch the channel switching valve such that a refrigerant flows through in the order of the outdoor heat exchanger, the second expansion valve, the liquid pipe, the first expansion valve, and the indoor heat exchanger at the time of a cooling operation, calculate a degree-of-dryness of the refrigerant flowing into the indoor heat exchanger at the time of the cooling operation based on a condensation temperature detected by an indoor heat exchange temperature sensor at the time of the cooling operation, an evaporation temperature detected by an outdoor heat exchange temperature sensor at the time of the cooling operation, and a condenser outlet temperature detected by an indoor-side refrigerant temperature sensor at the time of the cooling operation, perform, at the time of the cooling operation, when the degree-of-dryness is less than or equal to a threshold that is determined in advance, a normal mode of controlling the second expansion valve such that the refrigerant flowing inside the liquid pipe is in a gas-liquid two phase state and controlling the first expansion valve such that the degree of opening of the first expansion valve is equal to a predetermined degree of opening, and inhibit control, when the degree-of-dryness exceeds the threshold, that is performed in the direction of decreasing the degree of opening of the second expansion valve.

5. The air conditioning apparatus according to claim 4, wherein the controller is further configured to:

detect a discharge temperature that is a temperature of the refrigerant discharged from the compressor, and control, during the inhibition mode, the degree of opening of the first expansion valve such that the discharge temperature is equal to a target value.

6. The air conditioning apparatus according to claim 4, wherein the controller is further configured to:

calculate a degree of superheat of the refrigerant taken into the compressor, and control the degree of opening of the first expansion valve such that the degree of superheat is equal to a target value during the inhibition mode.

* * * * *